United States Patent [19]

Johnson

[11] 4,052,095

[45] Oct. 4, 1977

[54] SYNTHETIC ORGANIC POLYMERIC SLING PROTECTED BY VULCANIZED OR CURED ELASTOMERIC LAMINATE AT LOAD CONTACTING AREA THEREOF

[75] Inventor: Charles E. Johnson, Kenmore, N.Y.

[73] Assignee: Buffalo Weaving and Belting Co., Buffalo, N.Y.

[21] Appl. No.: 628,958

[22] Filed: Nov. 5, 1975

[51] Int. Cl.[2] ..... B66C 1/12

[52] U.S. Cl. ..... 294/74; 428/172; 428/195

[58] Field of Search ..... 294/67 E, 67 EA, 74, 294/75, 76, 77; 428/196, 195, 272; 182/137, 138

[56] References Cited

U.S. PATENT DOCUMENTS

| | | | |
|---|---|---|---|
| 2,561,215 | 7/1951 | Mighton | 428/272 |
| 2,972,799 | 2/1961 | Kern et al. | 428/195 |
| 3,290,083 | 12/1966 | Norton | 294/74 |

FOREIGN PATENT DOCUMENTS

| | | | |
|---|---|---|---|
| 798,197 | 11/1968 | Canada | 294/74 |
| 666,404 | 7/1963 | Canada | 294/74 |
| 1,202,841 | 1/1968 | United Kingdom | 294/74 |

*Primary Examiner*—James B. Marbert
*Attorney, Agent, or Firm*—Bean, Kauffman & Bean

[57] ABSTRACT

A web sling, such as one of the endless, standard eye-and-eye or twisted eye type, is made from a web of woven synthetic organic polymeric plastic strands, such as those made from nylon or polyethylene terephthalate filaments, with a lamina of elastomeric material, such as chloroprene rubber, vulcanized or cured onto a load contacting surface thereof. The elastomer penetrates surface openings between the polymeric plastic strands but may be prevented from penetrating through the web, when so desired. To assist the elastomer in holding tightly to the strands there is applied to the web before vulcanization a thin coating of a curable adhesive material, such as resorcinol-formaldehyde. In preferred embodiments of the invention particular thicknesses of filaments, strands, webs, adhesive coatings and elastomeric coverings are employed, the sides of the web are also integrally covered with the elastomer in the areas thereof designed to contact a load to be lifted and the areas thereof designed to contact the lifting member are also so covered. Also within the invention are methods of manufacturing the described webs and slings.

The slings of this invention are longer lasting than conventional nylon or polyester fiber slings because the rubber physically insulates the fibers of the web from loads carried and protects it against abrasion and cutting by the load, helps to reduce any shocking forces applied to the web by shiftings of loads and better secures the load in position in the sling. Similarly, when the lift contacting portions of the sling are covered with vulcanized elastomer they also last longer, primarily due to the elastomeric covering protecting against abrasion and cutting of the polymer filaments and strands by the lifting hook or other lifting member.

18 Claims, 6 Drawing Figures

SYNTHETIC ORGANIC POLYMERIC SLING PROTECTED BY VULCANIZED OR CURED ELASTOMERIC LAMINATE AT LOAD CONTACTING AREA THEREOF

This invention relates to slings, especially those of the flat web or strap type, normally employed for hoisting or lowering cargo before or after transportation or storage thereof. More particularly, it relates to slings made of webs of synthetic organic polymeric fibrous materials which have been protected at load contacting portions thereof so as to resist cutting and abrasion and thereby to provide longer sling life.

Slings made of synthetic organic polymers have been employed commercially in hoisting various types of cargoes and other materials. Such slings can, to a large extent, replace woven wire and cable slings because they are more economical, do not scratch highly polished surfaces of materials being hoisted and do not contain jagged edges of metal which may cut workers' hands. Additionally, such slings are normally resistant to water, unlike steel slings, which may rust, and if they are correctly chosen with respect to the material of construction, may be resistant to particular corrosive media.

Although slings made from nylon and polyesters are competitive with metal slings they are susceptible to abrasion and cutting by rough surfaced or sharp edged loads and the slight shifting of the load during movement may be enough, repeated many times, to cause separations of some of the filaments or strands of the sling, which weaken it and may cause it to require replacement before the expected end of its useful life. To avoid this pads, mats, protective edges and corners, etc., have been employed to cover such sharp and rough edges of the cargo but this requires additional handling, time and expense and sometimes the protective devices may accidentally be removed during hoisting or may be damaged or lost, resulting in wear on the sling. Sleeves of webbing of double or triple webbing thicknesses may be used at load contacting point to protect the principal web but the sleeves can be unintentionally moved from position and they and the multiple thickness can also be worn through by movements of loads.

The present invention provides a novel sling construction which results in the portions of the sling expected to be load contacting during use being covered with a protective elastomeric material tightly bound to the sling web of synthetic organic polymeric material and thick enough to prevent rough or sharp surfaces of cargo to other hoisted materials from penetrating it and cutting filaments or strands of the web. Although various other advantages of the invention will be described the main significance of the elastomer-protected polymeric web sling of this invention is in increasing the useful life of such slings, often by more than 100%, as from six months to two years.

In accordance with the present invention a sling, preferably a flat web or strap sling, comprises a web of woven synthetic organic polymeric strands, with a lamina of elastomeric material vulcanized or cured onto a load contacting surface thereof, such elastomeric laminate filling surface openings between the polymeric plastic strands and when desired, not penetrating the thickness of the web. Also within the invention are modifications of the sling described and methods for manufacture thereof.

The present invention will be readily understood by reference to the description herein of various preferred embodiments thereof, together with the drawing, in which.

Figure 1:
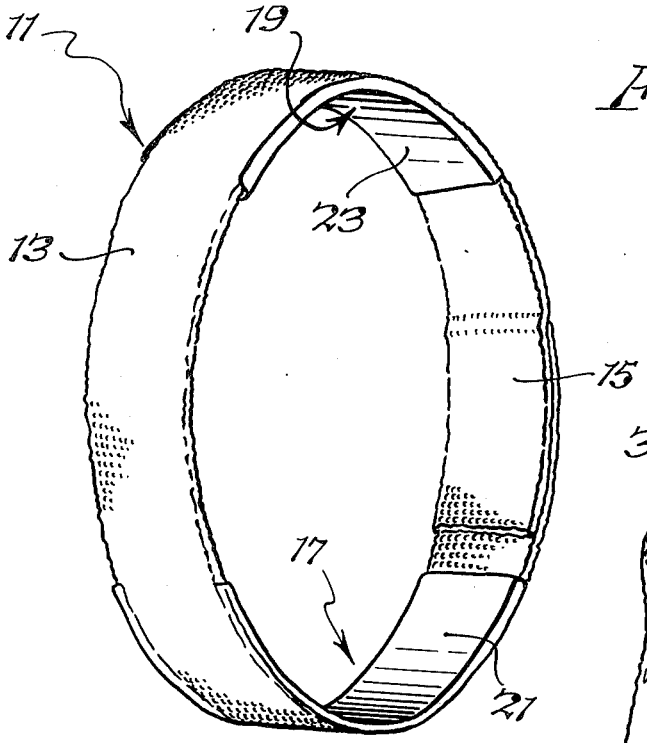
FIG. 1 is a perspective view of an endless strap or flat sling of the present invention showing vulcanized elastomeric protective coverings on both load contacting and lift contacting portions thereof.
Figure 2:
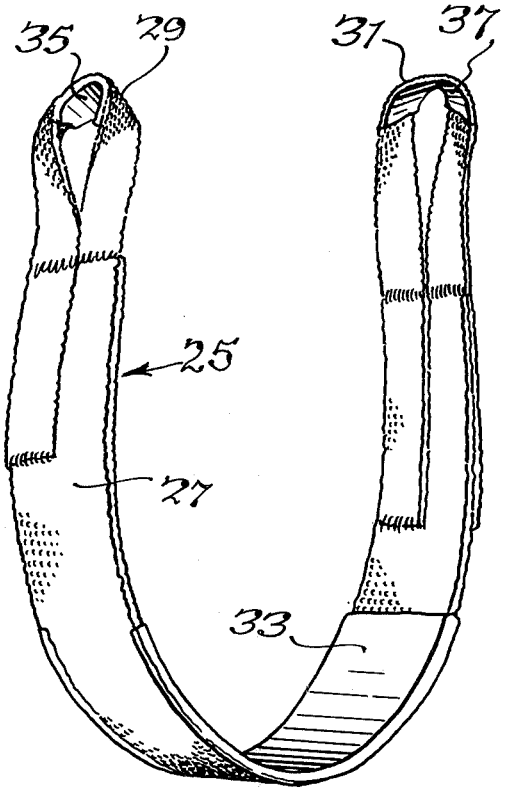
FIG. 2 is a perspective view of a twisted eye sling with protective covering at load contacting and lift contacting portions.
Figure 3:
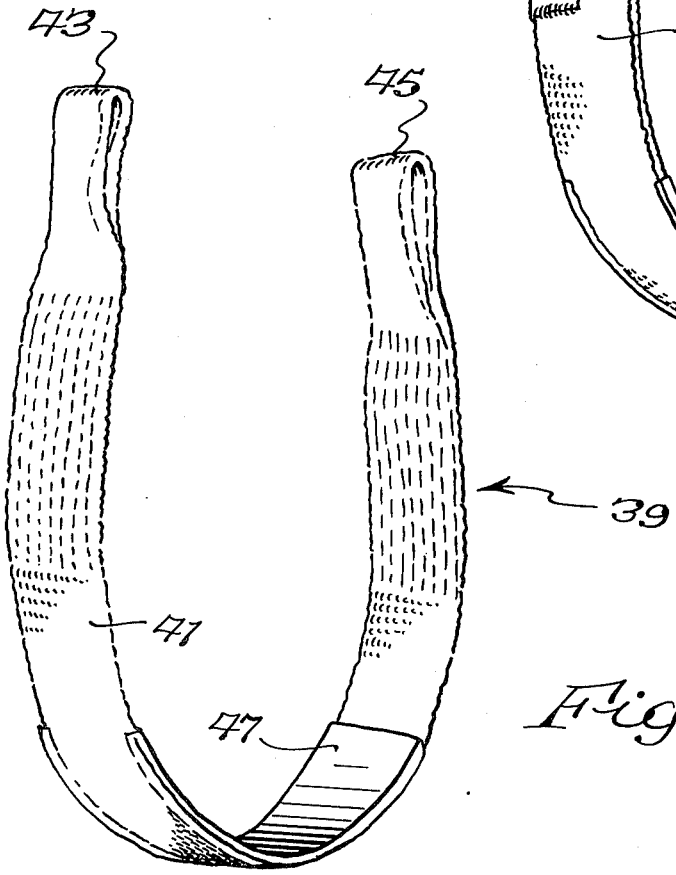
FIG. 3 is a standard eye-and-eye sling with protective elastomeric covering at a load contacting portion thereof.

Endless sling 11, illustrated in FIG. 1, is of a web 13 of woven synthetic organic polymeric strands, each of which is composed of polymeric filaments. The web is sewn onto itself at 15, preferably without twisting thereof. Load bearing or load contacting elastomeric protective covering portion 17 and lift, hook or hardware contacting portion 19 of the sling are shown covered by protective elastomeric coatings 21 and 23, respectively. In FIG. 2 sling 25 includes a web portion 27, two twisted eyes 29 and 31 and protective rubber coatings 33, 35 and 37, with the first of these being for the load contacting portion of the web and the last two being for the lift contacting portions of the eyes. In FIG. 3 standard eye-and-eye sling 39 includes a web portion 41 and standard eye portions 43 and 45, with the load contacting part of the web being protected by elastomeric covering 47.

Figure 4:
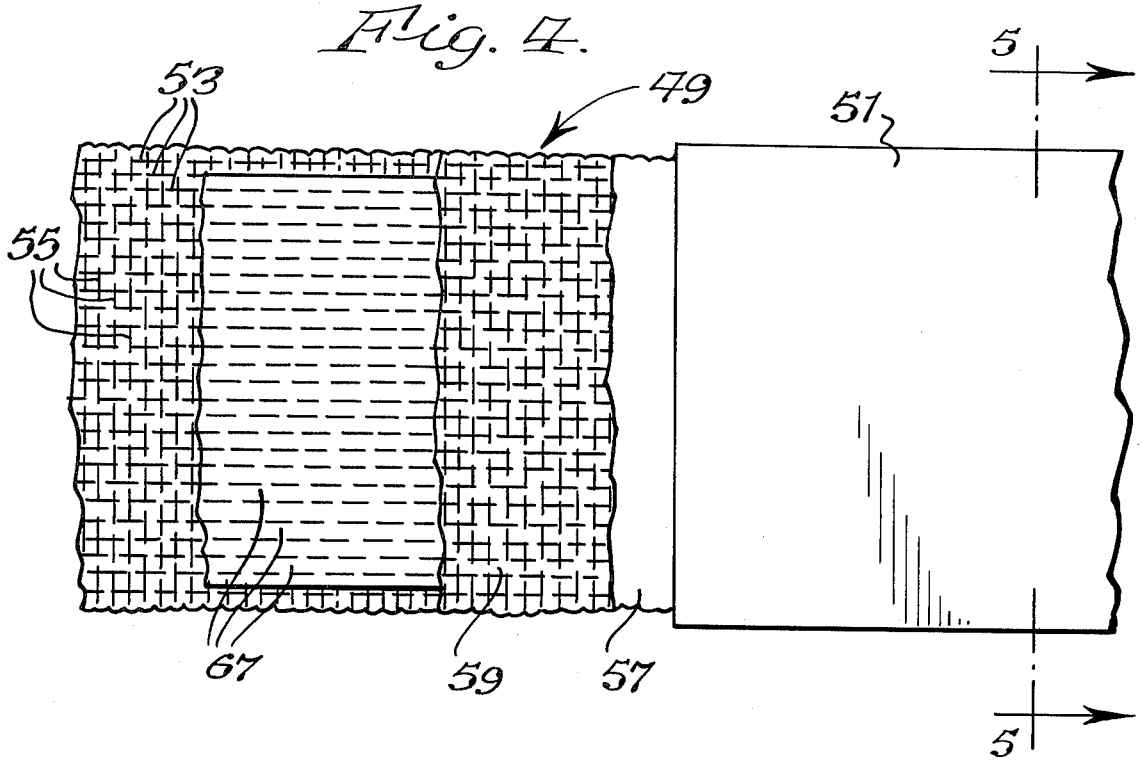
FIG. 4 is a partially cutaway top plan view of a portion of a sling of this invention showing a protective elastomeric covering thereon.

FIG. 4 shows a portion of a polymeric web 49 having an elastomeric protective covering 51 vulcanized to it. Warp yarns 53 and woof yarns 55 of the web are illustrated as are straight longitudinal yarns 67 also included in the present webs for their good load bearing capacities (they are not weakened by bending). Adjacent to the covering of protective elastomer 51 at 57 is a thinner coating of such elastomer to better help bind the end of the protective cover to the web. At section 59 is shown an adhesive coating on the web onto which the elastomer is placed and with which it is vulcanized or cured (but the adhesion agent does not always have to be curable).

Figure 5:
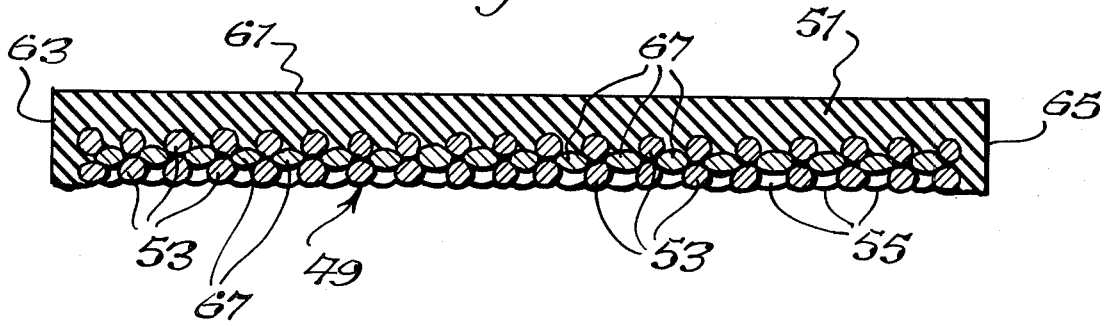
FIG. 5 is a transverse vertical sectional view along plane 5—5 of FIG. 4.
Figure 6:
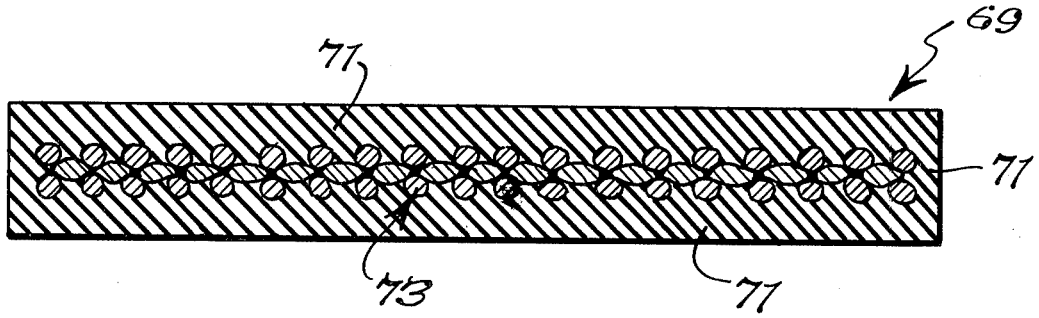
FIG. 6 is a corresponding vertical sectional view of another embodiment of the invention wherein the protective rubber coating is on both major surfaces and sides of the sling web.

In FIG. 5 elastomeric coating 51 is shown with a face 61 and sides 63 and 65 integral therewith coating web 49. Warp strands 53 are shown, as are straight longitudinal strands 67. The warp and woof strands are coated with elastomer at the face or major surface and the sides of the web and between the elastomer and the web is a thin coating of the adhesive, not designated in this view, which coats the yarns and impregnates them down to the individual fibers. FIG. 6 shows a variation of the elastomer covered web of FIG. 5, wherein the elastomeric coating is on both major faces and the sides of the web so that the web is completely surrounded by an integral elastomeric coating. The sling 69 illustrated has elastomeric covering 71 surrounding synthetic organic polymeric plastic web 73. The webs illustrated in FIGS.

4–6 are employed as load or lift contacting portions of the slings of FIGS. 1–3 but it is within this invention to coat all available surfaces of such slings.

The slings of this invention may be utilized in various manners to hoist cargo and other articles. For example, the highly versatile endless type sling illustrated in FIG. 1 can be used in a straight hitch, in a choker arrangement or as a basket sling. The twisted eye sling of FIG. 2 is especially adaptable for choker hitch use but may also be employed as a straight sling and as a basket sling, while the standard eye-and-eye is usually used in a basket or straight hitch configuration but may also be made into a choker hitch. The slings may be employed with hardware, usually metal fittings which are adapted to be held to sewn bights in the sling ends where the sling would otherwise contact a lighting hook or other lifting means. Normally the sling bights are sewn about the metal end fittings or the fittings may be bolted in place through a previously sewn end bight. The various types of slings and hardware for them are illustrated in Bulletin 705, entitled Buffalo Sling Guidebook and Price List, issued by Buffalo Weaving and Belting Company, 260 Chandler Street, Buffalo, N. Y. 14207, in 1974.

Although various synthetic organic polymeric materials may be employed for the manufacture of the web, including nylons, polyesters, poly-lower alkylenes (polyethylenes, polypropylenes and hybrids) acrylics, etc., the most preferred webs are those woven from nylon or polyester fibers or strands made from corresponding filaments. The nylons that may be used are crystalline, thermoplastic polyamide polymers having high tensile strengths, up to about 9 grams per denier, high melting points (223° C. for nylon 6 and 262° C. for nylon 66), low water absorption, good electrical resistance, high elasticity and low permanent elongation. The preferable nylon is nylon 66 but nylon 6 is also very useful and nylons 4, 9, 11, 12 and various others may also be employed. In general the nylons are attacked by strong mineral acids but are resistant to allkalis. Accordingly, nylon webs are normally employed where they will not be subjected to strong acids and where extension during use, due to their high elasticity, is unobjectionable. Polyester fibers and yarns, such as Dacron ® and other brands of polyethylene terephthalate, also have excellent tensile strengths, about 8 grams/denier. Such fibers elongate 10 to 36% before breaking and exhibit high elastic recovery. They are especialy useful for employment in acid and alkaline environments and when the greater stretchings of nylons would be objectionable. The filaments of the polymeric materials used may be of any suitable thicknesses, normally being at least 10 denier, about 0.1 microns, and rarely being in excess of 1 millimeter in diameter, with preferred ranges being from 0.001 or 0.01 mm. to 1 mm. Similarly, the number of filaments per strand or fiber is in the range of about 10 to 1,000, normally being 20 to 500, and the strand thickness is from 0.1 mm. to 1 cm., preferably 0.5 mm. to 1 cm. and most preferably about 0.5 mm. to 5 mm.

The synthetic organic polymeric webs employed may be of various types but it is preferred that they be woven and of the woven webs it is preferred to utilize those having central or internal straight fiber sections to assist in better supporting the load, due to untwisted orientations thereof. Furthermore, by utilizing a telltale of a different color fiber wear of the web in areas not covered by elastomer may be indicated. In general, ordinary belt weaves, such as are illustrated in the Buffalo Weaving and Belting Company Guidebook, previously referred to, are preferred but simple weaves may also be used. Of course, considering the type of weave, the size of the web, which may often be from 2 to 30 cm. wide, usually from 5 to 15 cm. wide and 0.2 to 2 cm. thick, preferably 0.3 to 1 cm. thick, will be sufficient to support the desired loads, often from 50 kg. to 50,000 kg., preferably 150 kg. to 5,000 kg. Sling lengths may be adjusted as desired but generally will be no shorter than 1.2 meters and usually are from 2 to 5 or 10 meters, although lengths to 50 are feasible. The sling structures are also usable as arrestors for moving objects, such as aircraft, automobiles, boats, etc., and in such use the elastomeric covering helps to prevent cutting through of the web of by the arrested object.

The lamina of elastomer which is vulcanized or cured onto a load contacting surface of the web of woven synthetic organic polymeric strands may be of any suitable tough elastomeric material, such as natural rubber, GR-S rubber, polychloroprene, polyurethane or polyolefin. Of these the most preferred and the main subject of this application is polychloroprene although the other elastomers may also be employed and various mixtures thereof may also be made. In addition to the polychloroprene, rubbers, natural rubbers (isoprene rubbers), GR-S rubber and polyurethanes are also often quite acceptable and in some usages may be preferred. Usually it will be best to use elastomers having toughness, elasticity, yield point, coefficient of friction and other relevant physical properties like those of polychloroprene, usually within the range of ±20%. The thickness of the elastomeric laminate on the surfaces of the web (on each face or side thereof) may be adjusted as desired for the particlar application but will normally be between 1 mm. and 2 cm., preferably 1 mm. to 1 cm. and more preferably about 2 mm. to 7 mm. Such a thickness on the sides as well as on the load contacting or load bearing (or lift contacting or lift bearing) face and even on the obverse face, is desirable so as to protect these surfaces of the web too, although primary protection should be on the load contacting surface where abrasion and cutting are most likely to take place.

The various elastomeric rubbers to be employed may be thermoplastic or thermosetting and may be cured or vulcanized. In preferred embodiments of the invention polychloroprene, GR-S and/or natural rubbers are vulcanized in place onto the woven web strands, utilizing an adhesive or other suitable substance for promoting strong holding of the elastomer to the web. Polychloroprene is highly preferred because of its strength, elasticity and resistance to normally corrosive media.

The adherence-promoting material utilized, usually in a thin coating on the filaments of the web strands, is preferably a hydroxyaryl-aldehyde condensate of the novolak type, which is capable of undergoing additional curing when heated to form a more highly polymeric material. A preferred embodiment of such compounds is a resorcinol-formaldehyde material but xylol-formaldehyde, phenol-formaldehyde, phenol-acetaldehyde and various other hydroxy-, dihydroxy-, and trihydroxy-benzene-lower (1–3 carbon atom) aldehyde products may also be employed. Generally, these are dissolved in a suitable solvent, e.g., benzene, ethanol, water acetone, and are applied to the polymeric web (as by dipping of the web into the liquid), allowing the web to be coated throughout and actually allowing the individual filaments to be coated and to a certain extent impregnated by the curable adhesive or adhesion promoting material. The strands of the web are impregnated with such coating and normally the external thickness thereof on the web is from 0.001 mm. to 0.1 mm., although other thicknesses may also be suitable. Internal penetration into the strand filaments has not been measured but it is generally considered to be about 1 to 50% of the external thickness. A most suitable preparation which has been employed successfully in manufacturing the present protected slings is that known as RFL, which is made for use in aiding the holding of rubbers onto substrates.

The elastomer-protected slings of the present invention are made by weaving a web of desired size from filaments, fibers or strands of polymeric material in the usual way known in the sling manufacturing art, preferably with straight line, longitudinal fibers between the warp and woof of the web; coating or impregnating it with the desired amount of solution of adhesion-promoting compound, usually in a solution which if of 10 to 50% solids content; evaporating off the solvent, if any; placing atop the surface to be coated a layer, lamina or sheet of rubber to be cured (including the usual vulcanizing or curing agent calendered into the sheet, but the rubber or elastomer mix may be made by other mixing or extruding technique or may be coated onto the textile web by dipping or spraying too, although these are less preferred methods; and vulcanizing or curing the rubber and adhesion agent. The adhesion promoter-coated web, with elastomer in place, is subjected to pressure, primarily exerted on the major faces thereof, together with heat, to vulcanize or cure it. The temperatures and pressures employed may be varied, depending on the particular vulcanizing or curing agents used and the percentages thereof present, which usually may be from about 0.01 to 5 %. Curing temperatures will normally be in the range of 50° to 200° C., preferably 80° to 170° C. and pressures will be from 3 kg./sq. cm. to 500 kg./cm., preferably from 10 to 100 kg./sq. cm. During the curing, which may take place in a suitable press or pressure mold, e.g., a platen press, the web may be held under tension, e.g., 1 to 1,000 kg./sq. cm., preferably 3 to 100 kg./sq. cm., to maintain the textile web in desired tight configuration during application of the protective elastomer to it, to prevent shrinkage thereof during the application of the elastomer and/or to stretch the polymeric strands during the vulcanizaton or cure to reduce end-use elongation (since the elastomer will resist returning the stretched textile to relaxed position). By such method the normal stretching of nylon web material may be reduced by as much as 25 to 90%, especially for initial loadings thereof and even polyester (Dacron®) stretching can be lowered. If the stretching is reduced then the abrading or cutting effects of sharp edges of the load on the elastomer or on other sections of the web will also be lessened (since stretching causes relative web motion with respect to the load) which is highly desirable to prolong sling life.

In usual manufacturing methods a web, either with the holding loops already sewn in or before such sewing or binding is treated with adherence promoting agent and is then coated on the face which will be contacting or bearing the designed load, with a layer of elastomer which is vulcanized or cured in place, preferably with the simultaneous curing of the adherence promoting agent so as to form a better bond to the polymeric fibrous substrate. The curing of the rubber or elastomer under pressure forces the elastomer to fill various openings between fibers of the substrate and thereby helps it better to hold onto these and to maintain them in position. However, the rubber does not normally penetrate through the web (usually only passing 10 to 50% of the distance through it) and thereby still allows a desired amount of sliding movement of the filaments as they stretch due to application of load or contract when the load is removed. However, in some instances, as when greater "rigidity" of the web is desired, the rubber may penetrate the web to an extent greater than 50%, even completely. The elastomer, in addition to protecting the web, helps to hold the strands thereof in desired orientation and helps to prevent disproportionate loadings of some parts of the web. The elastomer may be applied in a similar manner to the lift mechanism- or hardware-contacting part of the sling, which is usually the inner part of the loop or bight at the end of the sling, and such application may be before or after the bight is formed and sewn or otherwise fastened in place. If desired, a platen press or other means for vulcanizing the elastomer onto the web may be modified so as to allow applications of elastomer after sewing of the end and/or lift loops or bights. Normally, however, the bights will be made after application of the elastomer to the desired location. In some modifications of the manufacturing process the web may be treated with adhesion agent at a number of locations thereon, e.g., the load contacting and lift contacting sections (before sewing of the lift loops), and then the elastomer may be applied to such sections either simultaneously, as is preferred, using a press equipped to press both sections at one time, or sequentially. During the pressing operations some of the elastomer may be integrally applied in a thin film or coating (e.g., 0.1 to 5% of its protective thickness and about 1 to 10% of its length) to an area of the web adjacent to that where its protective thickness is applied, thus helping to prevent any possibility of easy peel-back of the protective elastomer when an end thereof is acted on by a shearing force.

The present slings and methods for their manufacture are significant improvements over previous slings, some of which may have been covered over portions of their lengths with thin rubber coatings, although in most cases plain slings of woven polymeric filaments were employed. Of course, as was previously mentioned the protective thickness of elastomer prevents cutting, gouging and abrasion of the web and subjection of it to contacts with harmful liquid and gaseous media. Coating of the sides together with the load or lift contacting surface is important because the rubber is thereby better held to the textile web and the sides are also protected against accidental contacts with sharp or abrading objections. This good holding to the web is important because nylon and polyesters such as Dacron®, being extremely smooth, are often difficult to bond to coating materials. Also, the rubber lamina penetrates surface openings between the strands for better holding but needs not interfere with the other smooth surface-to-surface contact of the strands. The adhesion agent, normally being curable at the same time the rubber is cured or vulcanized, bonds well to both the rubber and the textile web which it has previously impregnated. It provides a coating which additionally protects the web against corrosive atmospheres and liquid media and at the same time tends to stiffen the strands somewhat so as to make them less yielding upon the application of a load. When the strands are maintained under tension during curing of the elastomer thereon such stretchability of the load contacting portion is further diminished.

Similarly, the presence of the thin coating of adhesion agent helps to diminish possible moisture absorption by the filaments on "unprotected" parts thereof, which absorption could otherwise cut the load carrying capacity of the sling by more than 10%. These various advantages often add up to a significant improvement in sling operating characteristics and an increase in sling life of even more than 100%, for example, from 6 months to 2 years in use hoisting sharp edged metal cargoes or packing cases.

The following examples illustrate the invention but do not limit it. Unless other mentioned all temperatures are in ° C. and parts are by weight.

EXAMPLE 1

An endless strap sling of the type illustrated in FIG. 1 and of the structure shown in FIGS. 4 and 5 is made from 1,100 denier polyethylene terephthalate (Dacron®) strands or plies (with the individual fibers therein being of about 10 to 50 denier), twisted together to form 8 ply yarns and woven in known manner to the 10 centimeter width and 6 millimeter thickness web of FIGS. 4 and 5.

The web made, easily capable supporting a five metric ton load in single thickness, is next dipped into an RFL solution or dispersion (RFL stands for resorcinol-formaldehyde-latex) of the following composition):

| | Parts |
|---|---|
| Resorcinol | 16.6 |
| Formaldehyde (37% aqueous solution) | 14.7 |
| NaOH (50% aqueous solution) | 2.6 |
| Water (Buffalo, N.Y. tap) | 331.1 |
| Gen-Tac Latex (vinyl-pyridine latex, 41% solids, General Tire and Rubber Company) | 195.0 |
| Pliolite Latex No. 2108 (styrene-butadiene rubber latex, 40% solids, Goodyear Tire and Rubber Company, Chemical Division) | 50.0 |

The RFL solution is produced by mixing together at room temperature the resorcinol, formaldehyde solution, sodium hydroxide and water to produce the resorcinol-formaldehyde component, separately mixing the Gen-Tac latex and the Pliolite Latex No. 2108, also at room temperature, to produce a latex mix and mixing the two pre-mixes together at room temperature. After mixing is completed the RFL product is aged 24 hours before use and is normally then employed to pre-coat the polyester web within a period of 7 days after manufacture, preferably within 1 or 2 days. During storage before use it is maintained at about room temperature, protected from undue heat and freezing.

After dipping the web into the RFL solution it is air dried and the add-on (dry) is at 12% of the web weight. The dipping is such that the area of application of the RFL extends over the surface of the web to which protective curable elastomer is to be applied plus an area beyond that on each side of the protective elastomer area, extending on each side for about 20% of the length of the protective elastomer section. The RFL penetrates through the web and coats the fibers, plies (strands) and yarns and even impregnates the individual fibers or filaments to an extent in the range of 1 to 50% of the thickness thereof. The RFL solids may add about a 0.01 mm. thickness onto the surface of the exterior fibers or the strands.

After drying of the web containing the RFL a sheet of curable polychloroprene (neoprene) of a width of 11 cm. and a thickness of 5 mm. is placed on the web and the web, which is of sufficient length to produce a one-piece sling, with the polychloroprene strip in desired protective position, is placed in a heated platen press, which is so shaped as to allow the polychloroprene to flow and cure in position on the sides of the web as well as on the one major surface thereof to be protected, and a pressure of 20 kg./sq. cm. gauge is applied at a temperature of 157° C for 30 minutes. The mold is then cooled and the woven web with the protective coating of cured polychloroprene elastomer on the major surface and on the sides thereof about 3 mm. thick and filling the openings between the yarns at the major surface and sides and extending about 10% of the distance through the web, is removed.

The web is then cut to desired length and the ends thereof are sewn or otherwise satisfactorily fastened together to form an endless strap or flat sling with the vulcanized elastomeric protective covering on the load contacting portion thereof and the corresponding sides. Such a sling, when used to hoist sharp edged heavy metal objects, has a useful life of about 18 months, compared to a useful life of about half that time for an unprotected sling of the same type. Furthermore, when the protective surface has been cut or scraped so that it is no longer considered sufficiently impervious to protect the web beneath, it is treated with the RFL solution or dispersion and another strip of polychloroprene is applied and cured in place, thereby renewing the covering and again making the sling ready for use. In some cases, where the protective covering has been badly worn, it may be removed and a completely new coating may be applied. Such treatments extend the lives of such slings to a long as 5 years, compared to control sling lives which are often less than one year in severe applications.

In variations of the manufacturing procedure other webs are treated and coated with protective elastomer, with the webbing being of nylon 6, nylon 66 (both of 840 denier per ply), polyethylene, rayon, cotton and steel and mixtures or blends thereof, e.g., polyester-cotton, the webs are from 5 to 15 cm. in width and 0.3 to 1 cm. in thickness and the slings made are of lengths (before fastening the ends together) of 2 to 5 meters. Instead of employing polychloroprene sheets, natural rubber, GR-S rubber and polyurethane elastomer are used and in some applications the rubbers are applied in powder or crumb forms. Curing temperatures are varied satisfactorily over the range of 80° to 170° C., pressures applied are from 10 to 100 kg./sq. cm. and curing times are varied from 5 minutes to 2 hours, usually depending at least in part on the thickness of the elastomeric covering, such thicknesses being from 2 to 7 mm.

The slings made using the polyester and nylon fibers and strands are considered to be superior in overall properties (strength, resilience, resistance to corrosives) to those of the other materials and the polychloroprene coatings are considered to be better than the others mentioned.

In a further modification of the above procedures, slings of the endless strap type are made with additional sections of elastomer coated thereon at a surface opposite to that of the described coating (or opposite to it after the web has been sewn into an endless strap) where a hook or lifting element is normally applied to the sling during use. It is noted that the presence of such protective covering additionally helps to prevent wear of the sling at such a lifting strain point and extends its useful life in those cases where lifting hooks, rather than special fittings, are employed to apply lifting forces to the slings.

When the described procedure is followed except for the omission of pre-treatment of the web before application of the elastomeric coating the coating does not hold as satisfactorily to the web and tends to peel off during use. When the resorcinol-formaldehyde portion of the RFL composition is applied alone (with the sodium hydroxide and water but without the latices), the bond made, while satisfactory for various purposes, is not as good as that obtained when the latex is also present. Similarly, use of either the vinyl-pyridine latex or the styrene-butadiene latex with the RF components of the pre-treatments but without the other latex results in a bond of the neoprene or other covering material that is not as satisfactory as that described in the above example. As substitutes for the resorcinol-formaldehyde there may be used xylol-formaldehyde, phenol-formaldehyde, phenol-acetaldehyde and other hydroxybenzene-lower aldehyde condensates, and other solvents may be employed too, e.g., ethanol. Other suitable elastomer latices may also be used, e.g., natural rubber, polychloroprene, and applications may be by roller or spraying instead of by dipping.

In another preferred embodiment of the invention, illustrated in FIG. 4, a thin layer of elastomeric coating extends beyond the ends of the major thickness of such coating. This helps to seal the main section of elastomeric coating in place better and to prevent accidental removing of it or curling up of the edges by lateral or sliding contact with a load on the sling. Thus, because of the presence of the "extension" of elastomeric covering, which may be about 1 to 50% of the protective thickness and about 1 to 30% of the length thereof (the protective covering length usually being in the range of about 20 cm. to 1.5 m.), the main protective covering is held more tightly to the web and curling of the ends during use is lessened or prevented. Instead of using a thin flat extension of the elastomeric covering it is often desirable to have it tapered, extending from the full thickness of the covering to a minimal thickness, thereby removing any side portion of the covering against which a moving load might bear to work loose the covering. The mentioned extensions of the covering are normally applied with the covering and are cured with it, preferably by having the mold shaped accordingly, but they may be applied separately too, as by brushing on and heat curing while molding the cover portion. Desirably, they also extend along the sides of the web.

The protective covering may sometimes be held better to the web by utilizing a less tightly woven web, with more openings in it, e.g., 1 to 10% free passage through the web, rather than the present 0%, and/or with the curing pressures and temperatures being at the high ends of the ranges previously given, whereby the elastomer can penetrate the web. However, while such structure may be desirable in some instances, in other cases it can interfere with the load bearing capabilities of the web fibers and therefore such penetration through the web is often avoided (the application of the hydroxybenzene-lower aldehyde-latex pre-polymer adhesive also helps to limit such penetration).

EXAMPLE 2

To make the described sling of Example 1 reversible and to have the protective elastomeric covering even more satisfactorily held to the web the procedures of Example 1 are modified so as to have two sheets of elastomer (or the equivalent of two sheets) employed and the mold is adapted to produce the type of covered web illustrated in FIG. 6. However, despite its advantages a sling of such type is more expensive and often is unnecessary, since the protective portion of the sling may well outwear other parts thereof.

EXAMPLE 3

Slings of the types illustrated in FIGS. 2 and 3 are made according to the procedures of the foregoing examples. In modifications of the procedures the eyes of the slings also have protective coverings applied to the webs thereof before they are formed. Normally the protective coatings will be applied only on the insides of such eyes.

EXAMPLE 4

The slings previously described are first made, without the elastomeric protective coatings thereon, and after manufacture of the slings such coatings are cured into place, as previously described. The applications of the coatings and precoating materials are by the methods previously mentioned with the exception that the curing molds are modified so as to be able to apply the elastomeric coverings to the eye interiors.

EXAMPLE 5

The procedures of the foregoing examples are repeated but with tensions being placed on the webs during the curings of the protective elastomeric coverings thereon. Tensions applied are 3, 50 and 100 kg./sq. cm. and such applications are to webs of polyester (polyethylene terephthalate is preferred) and nylons. Upon the completion of molding and curing the tension is released. Yet, because the binding effect of the protective covering on the web the web is at least partially maintained in tension and the elastomeric covering is at least partially maintained in compression. This limits the initial stretching of the web where it is subjected to a load, often by 50 to 90% thereof, especially for the nylon webs, and thereby helps to prevent movements of the web surfaces with espect to the load, thereby diminishing wearing of the sling.

In this and the other examples the elastomeric nature of the coating is maintained by utilizing the normal proportions of curing agents in the rubber sheet, such as 1 to 5%, for example, 2% of sulfur, but the elasticity may be increased or diminished by varying the proportions thereof. However elasticity will usually be held to 50 to 1,000%. Usual other normal ingredients of rubbers may be present in the strip to be vulcanized to the web, such as accelerators, loading or filling agents, softeners, extenders, colors, antioxidants, antiozonants, odorants, etc. Normally the amounts of such materials will be in the range of 0.01 to 5% and the total content of such will be no more than 50% of the final rubber, preferably less than 10% thereof. As examples of specific materials of such types that may be employed in the various useful rubbers there may be mentioned zinc oxide, stearic acid, mercaptobenzothiazole, phenols and bisphenols.

The invention has been described with respect to illustrations and examples thereof but is not to be limited to these because it is evident that one of skill in the art can utilize substitutes and equivalents without departing from it.

What is claimed is:

1. A sling which comprises a web of woven synthetic organic polymeric strands of a nylon or polyester filament with a lamina of elastomeric polychloroprene rubber material vulcanized or cured onto a load contacting surface thereof and filling surface openings between the polymeric strands.

2. A sling according to claim 1 wherein the synthetic organic polymeric plastic filaments are of nylon 66, nylon 6 or polyethylene terephthalate and the rubber is polychloroprene.

3. A sling according to claim 1 wherein between the synthetic organic polymeric strands and the laminate of elastomeric material is a thin coating on the strands and filaments thereof of a material which aids adhesion of the elastomer to the strands.

4. A sling according to claim 2 wherein between the nylon 66, nylon 6 or polyethylene terephthalate strands and the polychloroprene laminate is a thin coating on the strands and filaments thereof of a material which aids adhesion of the elastomer to the strands.

5. A sling according to claim 4 wherein the thin coating is of a resorcinol-formaldehyde adhesive.

6. A sling according to claim 3 wherein the adhesive material impregnates the strands.

7. A sling according to claim 5 wherein the resorcinol formaldehyde adhesive impregnates the strands and coats the filaments thereof.

8. A sling according to claim 7 wherein the filaments are of diameter in the range of 0.01 mm. to 1 mm., the number of filaments per strand is in the range of 20 to 500, the strand thickness is from 0.5 mm. to 1 cm., the resorcinol formaldehyde adhesive is an RFL adhesive, the thickness thereof on the web is from 0.001 mm. to 0.1 mm., the thickness of the neoprene laminate on a surface of the web is from 1 mm. to 1 cm. and the web is from 0.2 to 2 cm. thick.

9. A sling according to claim 8 wherein the polychloroprene laminate covers a load contacting face area of the web and adjacent sides thereof.

10. A sling according to claim 9 wherein the polychloroprene laminate also covers the corresponding reverse face area of the web, integrally with the load contacting surface and sides thereof and is integrally vulcanized therewith.

11. A sling according to claim 1 wherein, in addition to the load contacting surface being laminated with elastomeric material, a lift contacting surface is also so laminated.

12. A sling according to claim 1 wherein the elastomeric material does not penetrate the thickness of the web.

13. A sling according to claim 9 wherein the polychloroprene laminate also covers a lift contacting surface of the web and edges thereof.

14. A sling according to claim 9 wherein the synthetic organic polymeric filaments are of nylon 66.

15. A sling according to claim 9 wherein the synthetic organic polymeric filaments are of polyethylene terephthalate.

16. A sling according to claim 8 wherein a thin covering of cured elastomer is present on the load bearing surface of the web at the ends of and contiguous with the protective lamina of elastomeric material, which covering is from 0.1 to 100% of the thickness of the protective elastomeric lamina and is of an average of no more than 50% of such thickness and extends from 1 to 30% of the length of said protective lamina.

17. A sling according to claim 1 wherein the filament is of nylon and the polychloroprene is vulcanized onto a load bearing surface of the web.

18. A sling according to claim 1 wherein the filament is of polyester and the polychloroprene is vulcanized onto a load bearing surface of the web.

* * * * *